United States Patent [19]

Nagatomo

[11] Patent Number: 4,686,782

[45] Date of Patent: Aug. 18, 1987

[54] APPARATUS FOR OPERATING WORKING ELEMENT OF EXCAVATOR

[75] Inventor: Masatsugu Nagatomo, Komatsu, Japan

[73] Assignee: Kabushiki Kaisha Komatsu Seisakusho, Tokyo, Japan

[21] Appl. No.: 814,434

[22] Filed: Dec. 30, 1985

[51] Int. Cl.[4] ..... E02F 5/02

[52] U.S. Cl. ..... 37/103; 414/694

[58] Field of Search ..... 37/103, 117.5; 414/686-692, 694, 695, 708, 710-713, 715, 718, 722, 723, 727

[56] References Cited

U.S. PATENT DOCUMENTS

| | | | |
|---|---|---|---|
| 3,042,233 | 7/1962 | Wills | 414/694 |
| 3,057,494 | 10/1962 | Holupainen et al. | 414/694 |
| 3,148,788 | 9/1964 | Ferwerda | 414/694 |
| 3,339,763 | 9/1967 | Caywood et al. | 414/694 |
| 3,390,794 | 7/1968 | McMullen et al. | 414/694 |
| 3,532,234 | 10/1970 | Grant | 414/694 |
| 3,554,395 | 1/1971 | Dunbar | 414/694 |
| 3,578,188 | 5/1971 | Drieschner | 37/103 |
| 3,653,131 | 4/1972 | Pilch | 414/718 X |
| 4,069,637 | 1/1978 | Braithwaite | 414/694 X |
| 4,553,899 | 11/1985 | Magni | 414/718 |

*Primary Examiner*—E. H. Eickholt

*Attorney, Agent, or Firm*—Armstrong, Nikaido, Marmelstein & Kubovcik

[57] ABSTRACT

An apparatus for the operation of a working element of an excavator. An arm connected to the working element and a boom for supporting and operating the arm are fabricated each in the shape of a hollow tube whose opposite ends are left unclosed. A boom cylinder, an arm cylinder, or a working element cylinder is disposed as contained within the boom or the arm. The point of connection of the boom to the arm and the point of connection of the working element cylinder to the arm constitute a joint fulcrum. The point of connection of the boom cylinder to the boom and the point of connection of the arm cylinder to the boom similarly constitute a joint fulcrum.

7 Claims, 4 Drawing Figures

APPARATUS FOR OPERATING WORKING ELEMENT OF EXCAVATOR

BACKGROUND OF THE INVENTION

1. Field of the Invention

This invention relates to an apparatus for the operation of the working element of an excavator such as a power shovel, and particularly pertains to the construction for attachment of the apparatus to the excavator.

2. Description of the Prior Art

Generally the boom and the arm for operating the working element such as of a hydraulic excavator are fabricated by welding sheet metal pieces each in a box-like section. Such fabrication of the boom and the arm in the box-like section as mentioned above involves a very long welding line and entails a very high cost of production. Bending load and torsional load of great magnitude are exerted on the boom and the arm and stress is concentrated on their welded parts. Thus, it is necessary that the boom and the arm be designed in heavy construction strong enough to withstand the moments produced by such external forces as mentioned above.

Further, in the conventional hydraulic excavator, since the three fulcral joints with the hydraulic cylinders serving to retain and change the postures of boom, arm and bucket are formed independently of one another and the bending and torsional moments are large in the regions of approximation between the fulcrums, the efforts directed to enhancing strength inevitably entail a great increase in weight and in the number of steps involved in the fabrication of fulcral structures, proving the manufacture to be a work of much time and labor.

Further, since the aforementioned hydraulic cylinders for retaining and changing the postures of the boom, the arm, and the bucket independently of each other are generally disposed on the outer walls along the aforementioned members, the configuration of the working extension (consisting of the hydraulic cylinders, the boom, and the arm) has no neat appearance from the aesthetic point of view.

Concerning the first of the problems mentioned above, U.S. Pat. No. 4,069,637 discloses a boom fabricated in a tubular cross section which offers strong resistance to torsional load and decreases the total length of welding lines. The invention disclosed in the aforementioned U.S. patent contemplates closing the tube ends of the boom and refusing the hydraulic cylinders inertion in the boom and, in the arrangement for attachment of hydraulic cylinders, fails to contemplate designing the attachment for further lowering moments by reason of the tubular section of the boom (arm), simplifying the process of fabrication, or improving the appearance of the configuration of the working extension.

SUMMARY OF THE INVENTION

An object of this invention, therefore, is to overcome the aforementioned problems of the prior art and provide an apparatus for the operation of working elements of an excavator, which permits reinforcement of the strength of the boom and the arm and, at the same time, ensures enhancement of the aesthetic sense.

Another object of this invention is to provide an apparatus for the operation of the working elements of an excavator or the configuration of the attachment of the apparatus, which permits reduction in bending and torsional moments exerted on the boom and the arm and simplification of the process of fabrication.

To accomplish the objects described above, the present invention has, as its primary aspect, provision of an improvement in an apparatus for the operation of a working element of an excavator provided with a boom, an arm connected at the rear end to the leading end of the boom and at the leading end thereof to the working element, a boom cylinder connected at one end thereof to the boom and adapted to impart a vertical rotary movement to the boom, an arm cylinder connected at one end thereof to the boom and at the other end thereof to the rear end of the arm and adapted to operate the arm, and a working element cylinder connected at one end thereof to the arm and at the other end thereof to the working element and adapted to operate the working element, which improvement comprises the boom and/or the arm being each fabricated in the shape of a hollow tube having the oppostite ends thereof left unclosed and at least one cylinder selected from the group consisting of the boom cylinder, the arm cylinder, and the working element cylinder being disposed as enclosed in the boom and/or the arm.

The other objects and characteristic features of the present invention will become apparent to those of ordinary skill in the art as the disclosure is made in the following description of a preferred embodiment of the invention, as illustrated in the accompanying drawings.

DETAILED DESCRIPTION OF THE INVENTION

Figure 1:
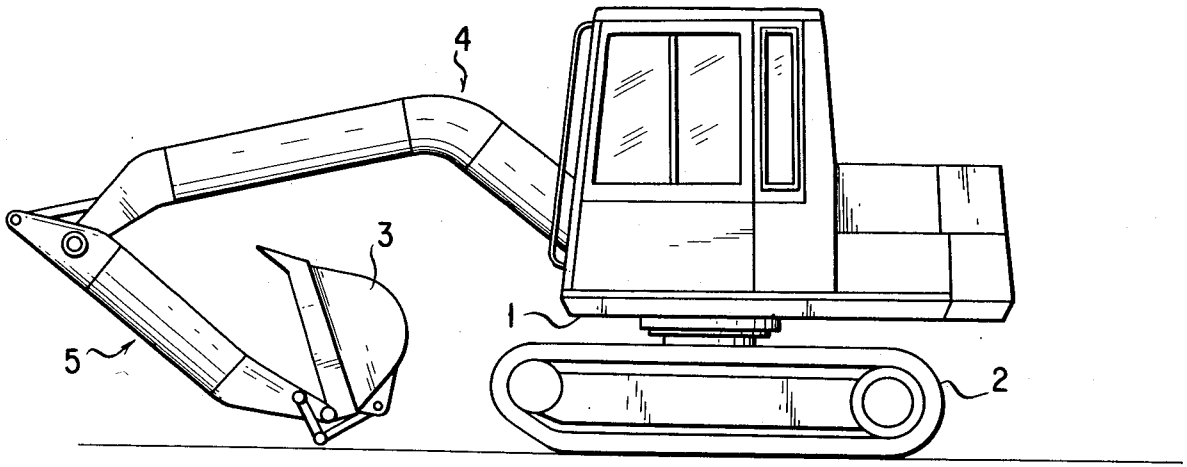
FIG. 1 is a side view of an excavator provided with an apparatus of the present invention for the operation of a working element.

Now, preferred embodiments of this invention will be described below with reference to the accompanying drawings. In the diagram of FIG. 1, numeral 1 stands for a vehicular body of an excavator possessing a track type undercarriage 2 and rotatably mounted on the undercarriage. The apparatus for operating a bucket 3 as the working element comprises a boom 4 attached to the vehicular body 1 in a manner enabling the boom 4 to generate a vertical rotary movement and an arm 5 attached swingably at one end thereof to the aforementioned boom 4 and attached at the other end thereof to the bucket 3 in such a manner that the bucket 3 will be allowed to rotate in the vertical direction about the point of attachment.

Figure 2:
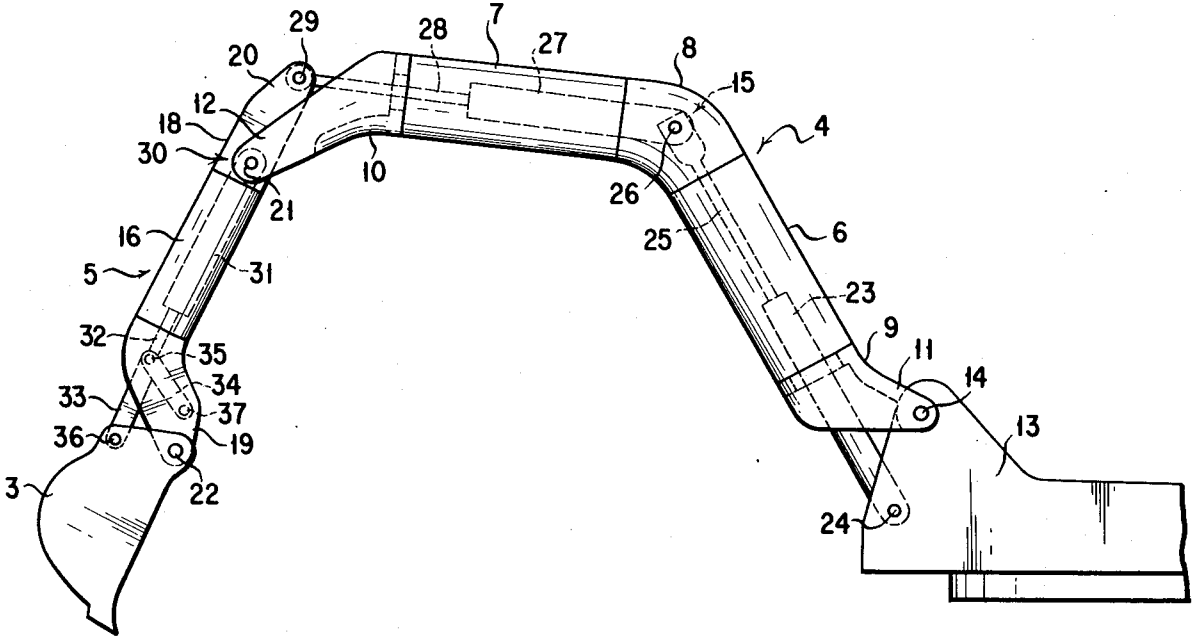
FIG. 2 is a side view of one embodiment of this invention.

With reference to FIG. 2, the boom 4 has a main body consisting of a linear rear boom member 6, a linear front boom member 7, and an elbow-shaped intermediate boom member 8 interconnecting the first two boom members fast to each other in such a manner that the three boom members will jointly assume the shape of diverged legs of the letter L. The front, rear, and intermediate boom members 7, 6, and 8 are each fabricated in the shape of a hollow tube of a circular or elliptic cross section. The rear boom member 6 is attached fast at the rear end thereof to a connecting member 9 possessing a two-prong forked bracket 11. The forked bracket 11 is so shaped that the lower end thereof will protrude outwardly from the rear boom member 6 roughly in the shape of diverged legs of the letter L. To the leading end of the front boom member 7 is attached fast a connecting member 10 possessing a similar two-prong forked bracket 12. The forked bracket 12 is so shaped that the upper end thereof will protrude inwardly from the aforementioned front boom member 7 roughly in the shape of diverged legs of the letter L. The aforementioned connecting members 9 and 10 may be formed by casting or fabricated with sheet metal pieces. They avoid blocking the rear end of the rear boom member 6 and the leading end of the front boom member 7. The boom 4 fabricated as described above is vertically rotatably attached to the vehicular body 1 by causing the forked bracket 11 of the connecting member 9 to be connected with a shaft pin to the upper part of a support bracket 13 of the vehicular body 1.

The arm 5 mentioned above possesses a linear arm member 16 fabricated in the shape of a hollow tube of a circular or elliptic section. A connecting member 17 possessing an inwardly extended two-prong fork bracket 19 is attached fast to the front end and a connecting member 18 possessing a two-prong forked bracket 20 is attached fast to the rear end respectively of the arm member 16. The connecting members 17 and 18 avoid blocking the front end and the rear end of the arm member 16. The forked bracket 12 of the front connecting member 10 of the boom 4 is connected with a shaft pin 21 to the rear connecting member 18 rear the arm member 16. The upper end of the bucket 3 is connected with a shaft pin 22 to the forked bracket 19 of the front connecting member 17.

To the lower part of the support bracket 13 of the vehicular body 1, the basal end of a boom cylinder 23 is connected with a shaft pin 24. The end of a piston rod 25 of the boom cylinder 23 is connected with a shaft pin 26 to a fulcrum 15 formed at the central bent part of the intermediate boom member 8. The boom cylinder 23 is enclosed in the boom 4. To the shaft pin 26 of the fulcrum 15 is connected the basal end of an arm cylinder 27. The point of connection of the boom cylinder 23 to the boom 4 and the point of connection of the arm cylinder 27 to the boom 4 constitute a joint fulcrum. The end of the piston rod 28 of the arm cylinder 27 is connected with a shaft pin 29 to the forked bracket 20 of the rear connecting member 18 of the arm 5. The arm cylinder 27 is enclosed with the boom 4.

The basal end of a working element cylinder 31 is connected to the shaft pin 21 of a connection part 30 between the boom 4 and the arm 5. The point of connection of the boom 4 to the arm 5 and the point of connection of the working element cylinder 31 to the arm also constitute a joint fulcrum. To the end of a piston rod 32 of the working element cylinder 31, one side ends of links 33 and 34 are connected with a pin 35. The other end of the link 33 is connected with a pin 36 to the rear upper end of the bucket 3 and the other end of the link 34 is connected with a pin 37 to the forked bracket 19.

Owing to the arrangement described above, the boom 4 is raised by extending the boom cylinder 23 and it is lowered by contracting the boom cylinder.

The arm 5 is swung by actuating the arm cylinder 27 and the bucket 3 is operated by actuating the working element cylinder 31.

The desire to enhance the strength of the boom 4 and that of the arm 5 can be attained by fabricating the boom and the arm each in the shape of a hollow tube of a circular or elliptic section very stable to withstand torsional load and the desire to improve the appearance of the apparatus as a whole is accomplished by causing hydraulic cylinders to be enclosed with the boom and/or the arm in the shape of the hollow tube. The face that the point of connection of the boom 4 to the arm 5 and the point of connection of the working element cylinder 31 to the arm constitute a joint fulcrum and the fact that the point of connection of the boom cylinder 23 to the boom 4 and the point of connection of the arm cylinder 27 to the boom 4 also constitute a joint fulcrum serve to lower the number of points of connection used in the apparatus as compared with the conventional countertype and simplify the process of fabrication of the apparatus. The coincidence of the positions of the fulcrums serves to lower the maximum moment and also lower the torsional and bending moments. The fact that this apparatus has no use for the additional connecting members indispensable to the conventional coutertype serves to lower the weight of the apparatus as a whole.

Figure 3:
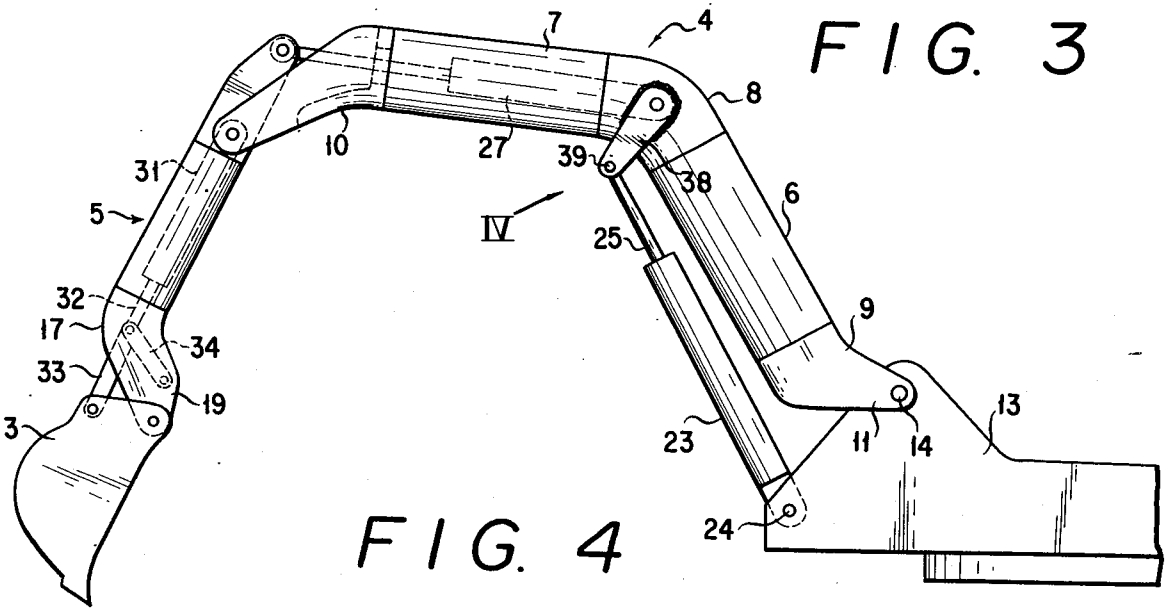
FIG. 3 is a side view of another embodiment of this invention.
Figure 4:
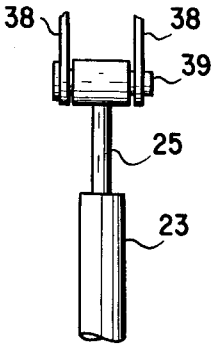
FIG. 4 is a front view of the embodiment of FIG. 3 as viewed from the side indicated by the symbol IV.

FIG. 3 and FIG. 4 illustrate other embodiments of this invention. They differ from the embodiment of FIG. 2 in the manner of attachment of the boom cylinder. A forked bracket 38 is welded to the opposite lateral parts of the intermediate boom member 8 and extended inwardly therein. The end of the piston rod 25 of the boom cylinder 23 is connected with a shaft pin 39 to the leading end of the end of the bracket 38 as illustrated in FIG. 4. In this embodiment, the arm cylinder 27 and the working element cylinder 31 are enclosed respectively within the hollow tubes of the boom 4 and the arm 5 and the boom cylinder 23 is not enclosed in the boom 4. The apparatus, therefore, has a neat appearance as compared with the conventional countertype. As already apparent to those akilled in the art, at least one cylinder selected from the group consisting of the boom cylinder 23, the arm cylinder 27, and the working element cylinder 31 can be enclosed within the boom 4 or the arm 5, enabling the apparatus to assume a neat appearance.

Obviously, many modifications and variations of the present invention are possible in light of the foregoing teachings. It is, therefore, to be understood that within the scope of the appended claims, the present invention may be practiced otherwise than as specifically described herein.

What I claim is:

1. In an apparatus for the operation of a working element of an excavator provided with a boom, an arm connected at the rear end to the leading end of said boom and at the leading end thereof to said working element, a boom cylinder connected at one end thereof to said boom and adapted to impart a vertical rotary movement to said boom, an arm cylinder connected at one end thereof to said boom and at the other end thereof to the rear end of said arm and adapted to operate said arm, and a working element cylinder connected at one end thereof to said arm and at the other end thereof to said working element and adapted to operate said working element, the improvement which comprises said boom and/or said arm being each fabricated in the shape of a hollow tube having the opposite ends thereof left unclosed and at least one cylinder selected from the group comprising said boom cylinder, said arm cylinder, and said working element cylinder being disposed as enclosed in said boom and/or said arm, the point of connection of said boom cylinder to said boom and the point of connection of said arm cylinder to said boom constituting a joint fulcrum, said joint fulcrum being formed in the central part of the bent portion of said intermediate boom member.

2. In an apparatus for the operation of a working element of an excavator provided with a boom, an arm connected at the rear end to the leading end of said boom and at the leading end thereof to said working element, a boom cylinder connected at one end thereof to said boom and adapted to impart a vertical rotary movement to said boom, an arm cylinder connected at one end thereof to said boom and at the other end thereof to the rear end of said arm and adapted to operate said arm, and a working element cylinder connected at one end thereof to said arm and at the other end thereof to said working element and adapted to operate said working element, the improvement which comprises said boom and/or said arm being each fabricated in the shape of a hollow tube having the opposite ends thereof left unclosed and at least one cylinder selected from the group comprising said boom cylinder, said arm cylinder, and said working element cylinder being disposed as enclosed in said boom and/or arm, said boom comprising a hollow tubular body composed of an elbow-shaped hollow intermediate boom member and a hollow front boom member and a hollow rear boom member attached fast to the opposite ends of said intermediate boom member, a connecting member attached fast to the end of said hollow rear boom member and adapted to connect said boom to fixing means serving to support said boom in place, and a connecting member attached fast to the end of said hollow front boom member and adapted to connect said boom to said arm, said intermediate, front, and rear boom members each possessing a circular or elliptic section, and the opposite ends of said boom being left unclosed.

3. An apparatus according to claim 2, wherein said hollow tubular body is fabricated substantially in the shape of diverged legs of the letter L as viewed sidewise.

4. An apparatus according to claim 2 or claim 3, wherein said connecting member attached fast to the leading end of said front boom member possesses an inwardly extended two-prong formed bracket.

5. An apparatus according to claim 2 or claim 3, wherein said connecting member attached fast to the rear end of said rear boom member possesses an outwardly extended two-prong forked bracket.

6. An apparatus according to claim 2, wherein the point of connection of said boom cylinder to said boom and the point of connection of said arm cylinder to said boom constitute a joint fulcrum.

7. An apparatus according to claim 6, wherein said joint fulcrum is formed in the central part of the bent portion of said intermediate boom member.

* * * * *